US011116277B2

(12) United States Patent
Casey

(10) Patent No.: US 11,116,277 B2
(45) Date of Patent: Sep. 14, 2021

(54) CUSTOMIZABLE SHOE ASSEMBLY

(71) Applicant: Edward Casey, Everitt, WA (US)

(72) Inventor: Edward Casey, Everitt, WA (US)

( * ) Notice: Subject to any disclaimer, the term of this patent is extended or adjusted under 35 U.S.C. 154(b) by 230 days.

(21) Appl. No.: 16/385,371

(22) Filed: Apr. 16, 2019

(65) Prior Publication Data

US 2020/0329807 A1 Oct. 22, 2020

(51) Int. Cl.

| | |
|---|---|
| ***A43B 3/24*** | (2006.01) |
| ***A43B 3/10*** | (2006.01) |
| ***A43B 1/00*** | (2006.01) |

(52) U.S. Cl.

CPC ..... *A43B 3/242* (2013.01); *A43B 1/0081* (2013.01); *A43B 3/101* (2013.01); *A43B 3/244* (2013.01)

(58) Field of Classification Search

CPC ..... A43B 3/24; A43B 3/242; A43B 3/244; A43B 3/101; A43B 1/0081

USPC ..... 36/100, 101

See application file for complete search history.

(56) References Cited

U.S. PATENT DOCUMENTS

| | | | | |
|---|---|---|---|---|
| 2,068,946 | A | 1/1937 | Ferguson | |
| 2,178,025 | A * | 10/1939 | Richter | A43B 3/24 36/101 |
| 2,236,367 | A * | 3/1941 | Gruber | A43B 3/24 36/101 |
| 3,012,341 | A * | 12/1961 | Schaefer | A43B 3/24 36/100 |
| 4,377,042 | A * | 3/1983 | Bauer | A43B 13/36 36/101 |
| 4,706,392 | A | 11/1987 | Yang | |
| 4,713,895 | A | 12/1987 | Vallieres | |
| 5,144,759 | A | 9/1992 | Mascotte | |
| 5,778,564 | A | 7/1998 | Kettner | |
| 7,350,321 | B2 | 4/2008 | Soon | |
| 7,698,834 | B1 * | 4/2010 | Courville | A43B 3/24 36/15 |
| D624,732 | S | 10/2010 | Hobby | |
| 2003/0177664 | A1 * | 9/2003 | Monassebian | A45C 3/08 36/100 |
| 2007/0039205 | A1 | 2/2007 | Erb | |

* cited by examiner

*Primary Examiner* — Ted Kavanaugh

(57) ABSTRACT

A customizable shoe assembly for altering the appearance of slippers includes a slipper that can be worn on a user's foot. The slipper has a sole, an insole lying on top of the sole to have the user's foot lie thereon and a body to surround the user's foot. A cover is provided and the cover is removably positioned on the slipper for completely covering the slipper. The cover is provided in a variety of colors to alter the appearance of the slipper.

4 Claims, 4 Drawing Sheets

CUSTOMIZABLE SHOE ASSEMBLY

CROSS-REFERENCE TO RELATED APPLICATIONS

Statement Regarding Federally Sponsored Research or Development

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to shoe devices and more particularly pertains to a new shoe device for altering the appearance of slippers.

BRIEF SUMMARY OF THE INVENTION

An embodiment of the disclosure meets the needs presented above by generally comprising a slipper that can be worn on a user's foot. The slipper has a sole, an insole lying on top of the sole to have the user's foot lie thereon and a body to surround the user's foot. A cover is provided and the cover is removably positioned on the slipper for completely covering the slipper. The cover is provided in a variety of colors to alter the appearance of the slipper.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
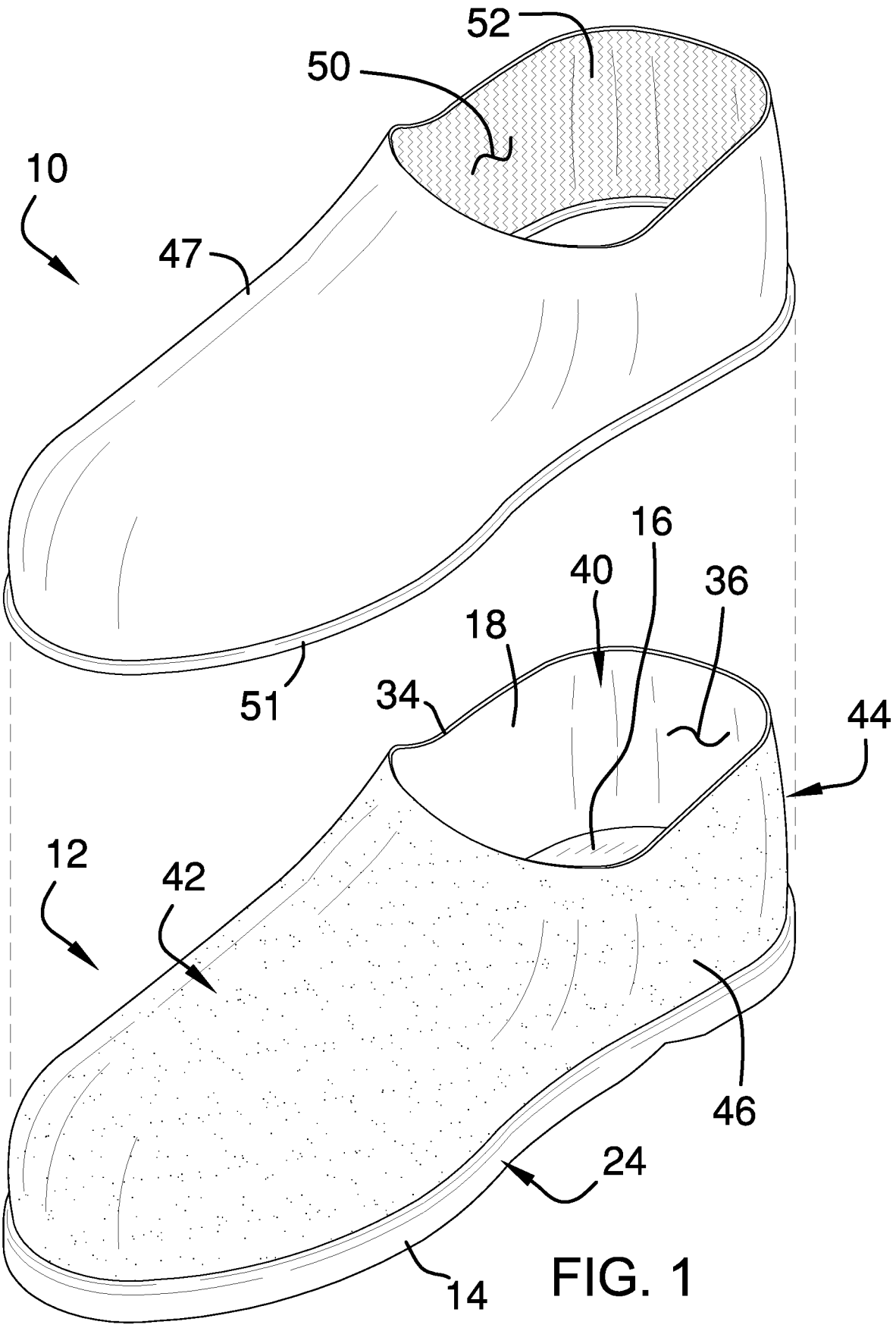
FIG. 1 is an exploded perspective view of a customizable shoe assembly according to an embodiment of the disclosure.
Figure 2:
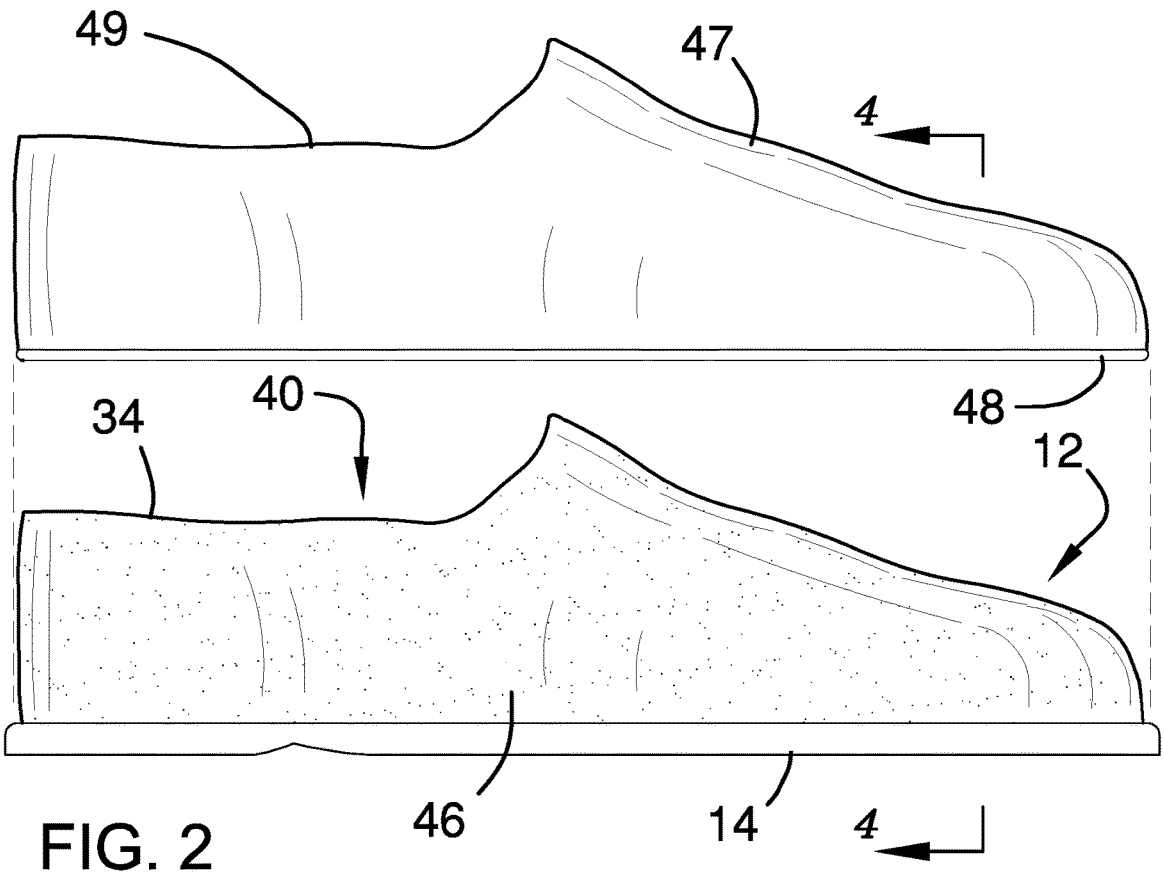
FIG. 2 is a right side view of an embodiment of the disclosure.
Figure 3:
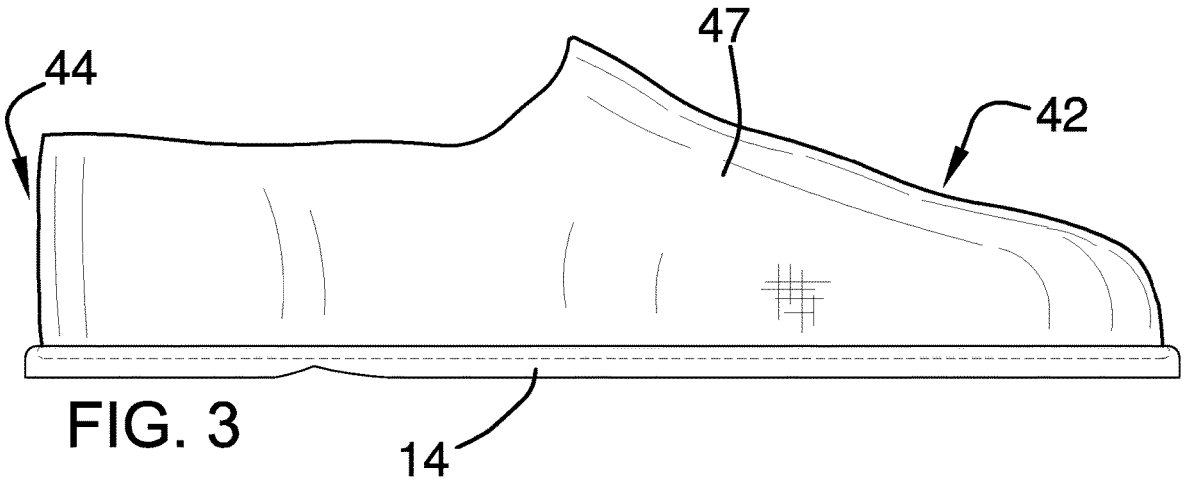
FIG. 3 is a right side view of an embodiment of the disclosure showing a cover having been positioned over a slipper.
Figure 4:
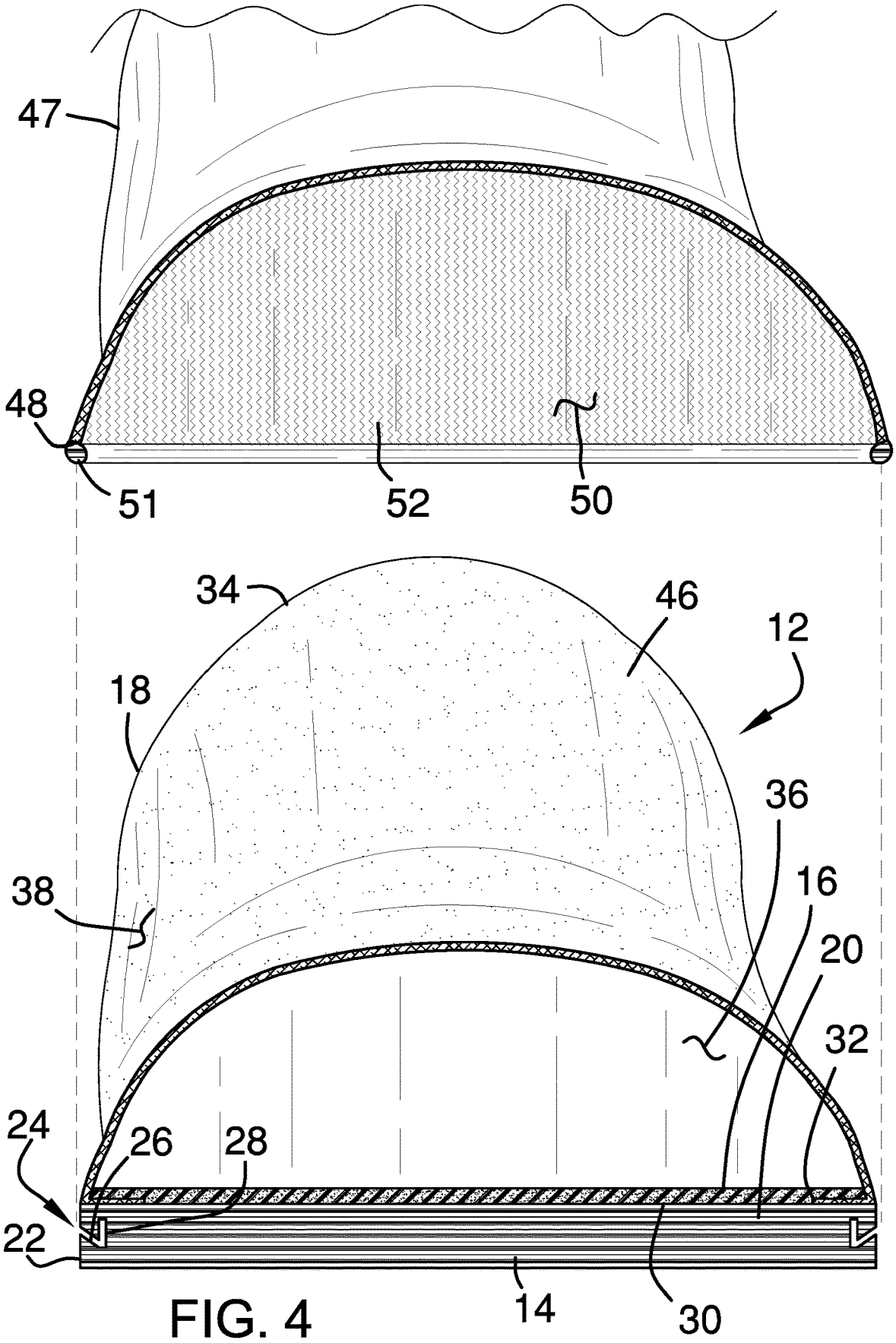
FIG. 4 is a cross sectional view taken along line 4-4 of FIG. 2 of an embodiment of the disclosure.
Figure 5:
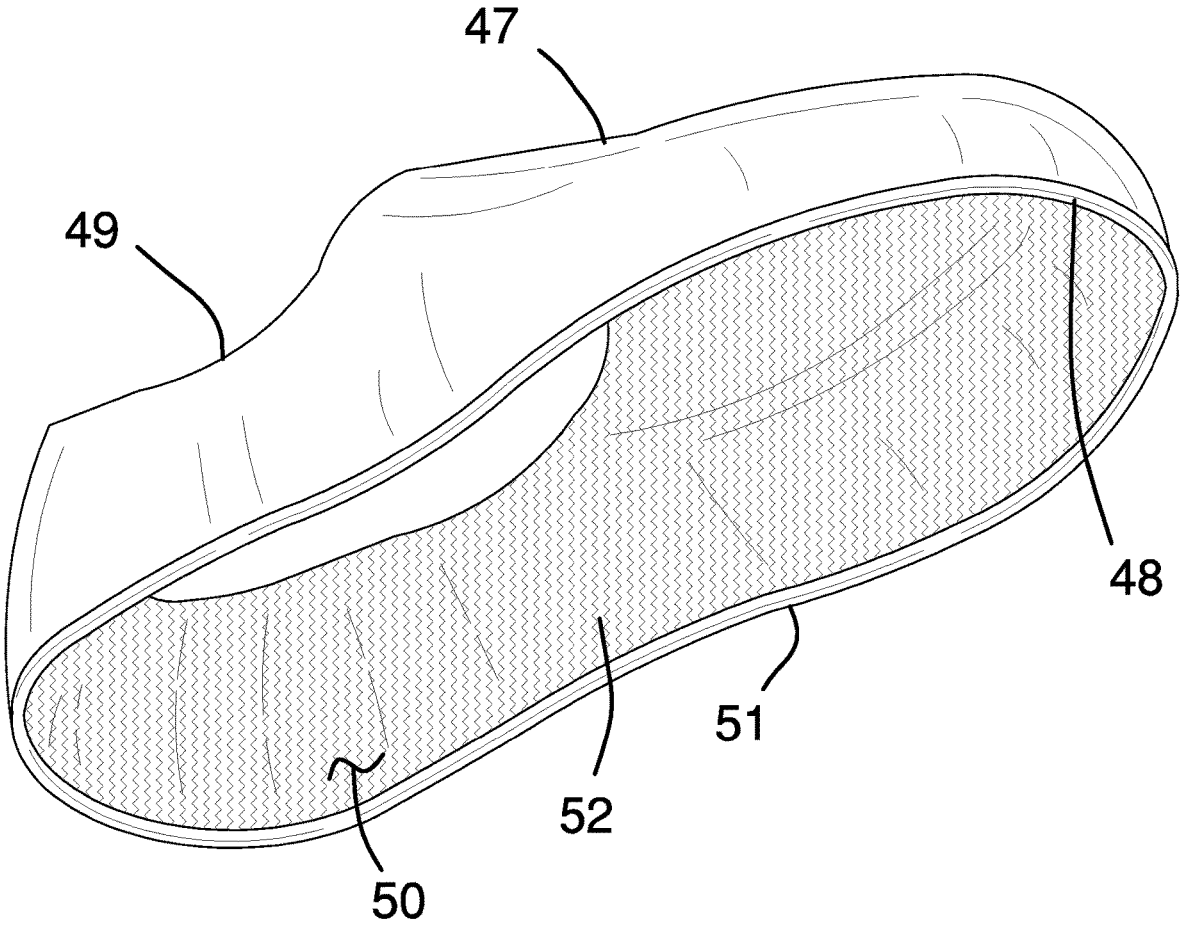
FIG. 5 is a bottom perspective view of a cover an embodiment of the disclosure.

With reference now to the drawings, and in particular to FIGS. 1 through 5 thereof, a new shoe device embodying the principles and concepts of an embodiment of the disclosure and generally designated by the reference numeral 10 will be described.

As best illustrated in FIGS. 1 through 5, the customizable shoe assembly 10 generally comprises a slipper 12 that can be worn on a user's foot. The slipper 12 has a sole 14, an insole 16 lying on top of the sole 14 for having the user's foot lie thereon and a body 18 for surrounding the user's foot. The sole 14 has a top surface 20 and a perimeter edge 22, and the perimeter edge 22 has a slot 24 extending inwardly therein and the slot 24 extends around an entire perimeter of the sole 14. As is most clearly shown in FIG. 4, the slot 24 has a first portion 26 that angles downwardly in the sole 14 and a second portion 28 that extends upwardly from the first portion 26.

The insole 16 has a bottom side 30 and the bottom side 30 rests on the top surface of the sole 14. The insole 16 completely covers the top surface 20 of the sole 14. The body 18 has a bottom edge 32, a top edge 34, an inside surface 36 and an outside surface 38. The bottom edge 32 is continuous such that the body 18 has an ovoid shape and the bottom edge 32 is tucked beneath the insole 16 and the sole 14 to attach the body 18 to the insole 16. The top edge 34 is continuously arcuate to define a foot hole 40 into the slipper 12. Additionally, the body 18 defines a foot portion 42 of the slipper 12 and a heel portion 44 of the slipper 12, and the foot hole 40 is aligned with the heel portion 44.

A first mating panel 46 is coupled to the body 18 and the first mating panel 46 is coupled to the outside surface 38 of the body 18 of the slipper 12. The first mating panel 46 completely covers the outside surface 38 of the body 18. Moreover, the first mating panel 46 is comprised of a hook or pile material.

A cover 47 is removably positioned on the slipper 12 for completely covering the slipper 12. The cover 47 is manufactured in a variety of colors to alter the appearance of the slipper 12. Additionally, the cover 47 conceals soiling or damage on the slipper 12. The cover 47 has a lower edge 48, an upper edge 49 and an interior surface 50. The interior surface 50 coextensively abuts the outside surface 38 of the body 18 when the cover 47 is positioned on the slipper 12. Additionally, the lower edge 48 of the cover 47 is aligned with the top surface 20 of the sole 14 and the upper edge 49 is aligned with and is coextensive with the top edge 34 of the body 18.

A band 51 is coupled to the lower edge 48 of the cover 47 and the band 51 extends around an entire perimeter of the lower edge 48. The band 51 engages the slot 24 in the sole 14 for closing the lower edge 48 of the cover 47 around the slipper 12. The band 51 is first extended downwardly in the first portion 26 of the slot 24 and subsequently urged upwardly in the second portion 28 of the slot 24. Additionally, the band 51 may be comprised of a deformable material for facilitating inserting the band 51 into the slot 24 and removing the band 51 from the slot 24.

A second mating panel 52 is coupled to the cover 47 and the second mating panel 52 releasably engages the first mating panel 46 for retaining the cover 47 on the slipper 12. The second mating panel 52 is positioned on the interior surface 49 of the cover 47 and the second mating panel 52 completely covers the interior surface 49. The second mating panel 52 is comprised of a complementary hook or pile material with respect to the first mating panel 46. Thus, the first 46 and second 50 mating panels engage and disengage each other in the convention of hook and loop fasteners.

In use, the slipper 12 is worn for day to day use as would be any other slipper. The cover 47 can be positioned over the body 18 of the slipper 12 to change the color of the slipper 12 or to conceal unsightly soiling or damage on the body 18 of the slipper 12. The band 51 on the cover 47 is inserted into the slot 24 in the sole 14 for retaining the cover 47 on the body 18. Additionally, the second mating panel 52 engages the first mating panel 46 to facilitate a uniform coupling between the cover 47 and the body 18.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure. Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A customizable shoe assembly being configured to present a variety of ornamental appearances to an observer, said assembly comprising:

a slipper being configured to be worn on a user's foot, said slipper having a sole, an insole lying on top of said sole wherein said insole is configured to have the user's foot lie thereon and a body being configured to surround the user's foot, said sole having a top surface and a perimeter edge, said perimeter edge having a slot extending inwardly therein, said slot extending around an entire perimeter of said sole, said slot having a first portion angling downwardly and a second portion extending upwardly from said first portion, said insole having a bottom side, said bottom side resting on said top surface of said sole, said insole completely covering said top surface of said sole; and a cover being removably positioned on said slipper for completely covering said slipper, said cover being colored wherein said cover is configured to alter the appearance of said slipper, said body having a bottom edge, a top edge, an inside surface and an outside surface, said bottom edge being continuous such that said body has an ovoid shape, said bottom edge being tucked beneath said insole and said sole to attach said body to said insole, said top edge being continuously arcuate to define a foot hole into said slipper, said body defining a foot portion of said slipper and a heel portion of said slipper, said foot hole aligned with said heel portion;

a first mating panel being coupled to said body, said first mating panel being coupled to said outside surface of said body of said slipper, said first mating panel completely covering said outside surface, said first mating panel being comprised of a hook or pile material; and a second mating panel being coupled to said cover, said second mating panel releasably engaging said first mating panel for retaining said cover on said slipper, said second mating panel being positioned on said interior surface of said cover, said second mating panel completely covering said interior surface, said second mating panel being comprised of a complementary hook or pile material with respect to said first mating panel.

2. The assembly according to claim 1, wherein said cover has a lower edge, an upper edge and an interior surface, said interior surface coextensively abutting said outside surface of said body when said cover is positioned on said slipper having said lower edge of said cover being aligned with said top surface of said sole and having said upper edge being aligned with and being coextensive with said top edge of said body.

3. The assembly according to claim 2, further comprising a band being coupled to said lower edge of said cover, said band extending around an entire perimeter of said lower edge, said band engaging said slot in said sole for closing said lower edge of said cover around said slipper.

4. A customizable shoe assembly being configured to present a variety of ornamental appearances to an observer, said assembly comprising:

a slipper being configured to be worn on a user's foot, said slipper having a sole, an insole lying on top of said sole wherein said insole is configured to have the user's foot lie thereon and an body being configured to surround the user's foot, said sole having a top surface and a perimeter edge, said perimeter edge having a slot extending inwardly therein, said slot extending around an entire perimeter of said sole, said slot having a first portion angling downwardly and a second portion extending upwardly from said first portion, said insole having a bottom side, said bottom side resting on said top surface of said sole, said insole completely covering said top surface of said sole, said body having a bottom edge, a top edge, an inside surface and an outside surface, said bottom edge being continuous such that said body has an ovoid shape, said bottom edge being tucked beneath said insole and said sole to attach said body to said insole, said top edge being continuously arcuate to define a foot hole into said slipper, said body defining a foot portion of said slipper and a heel portion of said slipper, said foot hole aligned with said heel portion;

a first mating panel being coupled to said body, said first mating panel being coupled to said outside surface of said body, said first mating panel completely covering said outside surface, said first mating panel being comprised of a hook or pile material;

a cover being removably positioned on said slipper for completely covering said slipper, said cover being colored wherein said cover is configure to alter the appearance of said slipper, said cover having a lower edge, an upper edge and an interior surface, said interior surface coextensively abutting said outside surface of said body when said cover is positioned on said slipper having said lower edge of said cover being aligned with said top surface of said sole and having said upper edge being aligned with and being coextensive with said top edge of said body;

a band being coupled to said lower edge of said cover, said band extending around an entire perimeter of said lower edge, said band engaging said slot in said sole for closing said lower edge of said cover around said slipper; and a second mating panel being coupled to said cover, said second mating panel releasably engaging said first mating panel for retaining said cover on said slipper, said second mating panel being positioned on said interior surface of said cover, said second mating panel completely covering said interior surface, said second mating panel being comprised of a complementary hook or pile material with respect to said first mating panel.

* * * * *